US005199815A

United States Patent [19]

Inoue et al.

[11] Patent Number: 5,199,815

[45] Date of Patent: Apr. 6, 1993

[54] FLOOR STRUCTURE FOR INDOOR ARTIFICIAL SKIING GROUND

[75] Inventors: Masanori Inoue; Susumu Kishi, both of Kawasaki, Japan

[73] Assignee: NKK Corporation, Tokyo, Japan

[21] Appl. No.: 722,330

[22] Filed: Jul. 2, 1991

[51] Int. Cl.[5] ..... E01C 5/22

[52] U.S. Cl. ..... 404/18; 404/32; 52/309.12; 52/516

[58] Field of Search ..... 404/17, 18, 31-33, 404/71; 280/842; 52/309.8, 309.9, 309.12-309.17, 516; 252/62

[56] References Cited

U.S. PATENT DOCUMENTS

| | | | |
|---|---|---|---|
| 2,358,023 | 9/1944 | Munters | 404/31 |
| 3,122,073 | 2/1964 | Masse | 404/18 X |
| 3,577,893 | 5/1971 | Towner | 404/32 X |
| 3,762,975 | 10/1973 | Iwasaki et al. | 404/77 X |
| 3,839,518 | 10/1974 | Rubens et al. | 404/32 X |
| 3,853,682 | 12/1974 | Hurst | 156/337 X |
| 4,068,023 | 1/1978 | Nielsen et al. | 427/204 X |
| 4,632,329 | 12/1986 | Burley | 52/3 X |
| 4,790,531 | 12/1988 | Matsui et al. | 52/187 X |
| 4,937,033 | 6/1990 | Oshio et al. | 264/256 |
| 4,976,422 | 12/1990 | Shimamura | 472/90 |

*Primary Examiner*—Ramon S. Britts
*Assistant Examiner*—Roger J. Schoeppel
*Attorney, Agent, or Firm*—Keck, Mahin & Cate

[57] ABSTRACT

A floor structure for indoor artificial skiing ground comprises, a concrete base plate constructed on foundations, a first waterproof covering disposed on the base plate, a heat insulation layer located on the first waterproof covering, a second waterproof covering disposed on the heat insulation layer, a concrete pressing plate location on the second waterproof covering, and a plurality of drainage grooves formed on top of the pressing plate.

Another floor structure for indoor artificial skiing ground comprises, a concrete base plate constructed on foundations, a first waterproof covering disposed on the base plate, a heat insulation layer located on the first waterproof covering, a second waterproof covering disposed on the heat insulation layer, and a slip preventive layer located on the second waterproof covering.

11 Claims, 2 Drawing Sheets

FLOOR STRUCTURE FOR INDOOR ARTIFICIAL SKIING GROUND

BACKGROUND OF THE INVENTION

1. Field of the Invention

The present invention relates to floor structures of slope on indoor artificial skiing grounds.

2. Description of the Related Arts

Recently, some indoor artificial skiing grounds have been built for people to enjoy winter sports in all seasons. For the indoor artificial skiing grounds, artificial snow is produced by a snow machine, and heaped on the indoor floor.

FIG. 5 is a sectional view showing an example of the conventional floor structure of indoor artificial skiing ground. As shown in FIG. 5, the floor comprises a concrete base plate 1, a waterproof layer 8, a crushed stone layer 9, permeable asphalt 10, and artificial lawn 11. The concrete base plate 1 is constructed on foundations. The crushed stone layer 9 is spread over the base plate 1 with the waterproof layer 8 interposed between them. The artificial lawn 11 is spread over the crushed stone layer 9 with the permeable asphalt 10 interposed between them. Reference numeral 6 denotes artificial snow heaped on the surface of the floor.

FIG. 6 is a sectional view showing another example of the conventional floor structure of indoor artificial skiing ground. As shown in FIG. 6, the floor comprises a concrete base plate 1, cooling pipes 12, a waterproof layer 8, and artificial lawn 11. The concrete base plate is constructed on foundations. The cooling pipes are embedded in the base plate at specified intervals, in which a cooling fluid flows. The artificial lawn 11 is spread over the base plate 1 with the waterproof layer 8 interposed between them. Reference numeral 6 denotes artificial snow heaped on the surface of the floor. For the floor shown in FIG. 5, heat insulation is not taken into consideration at all. When the snow heaped on the floor melts in large quantities, much artificial snow must be supplied to keep the slope in a good condition. The supply of large amounts of snow increases the snow making cost, making the indoor artificial skiing ground uneconomical.

The floor shown in FIG. 6 is always cooled by the cooling pipes 12 embedded in the concrete base plate 1. Therefore, the artificial snow 6 heaped on the floor will not melt, remaining forever. As a result, the snow is gradually made dirty by the skiing of skiers. In addition, the snow is melted by the frictional heat generated by the skiing of skiers, and is frozen immediately after being melted. This repetition of melting and freezing makes the snow particles coarse, which gradually changes the snow into ice. The slope is changed into "Eisbahn" (a frozen ski slope). As described above, the conventional floor structure for the indoor artificial skiing ground has some disadvantages: the heaped snow becomes dirty, and the snow is changed into a frozen condition, so that such a floor structure cannot provide continually powder-shaped snow of good quality for skiers.

SUMMARY OF THE INVENTION

It is an object of this invention to provide a floor structure for indoor artificial skiing ground on which good-quality powder-shaped snow can be laid at all times. To achieve the above object, this invention provides a floor structure for indoor artificial skiing ground, comprising:

a concrete base plate constructed on foundations;

a first waterproof covering disposed on the base plate;

a heat insulation layer located on the first waterproof covering;

a second waterproof covering disposed on the heat insulation layer;

a concrete pressing plate located on the second waterproof covering; and a plurality of drainage ditch formed on the upper surface of pressing plate.

Further, the present invention provides a floor structure for indoor artificial skiing ground, comprising;

a concrete base plate constructed on foundations;

a first waterproof covering disposed on the base plate;

a heat insulation layer located on the first waterproof covering;

a second waterproof covering disposed on the heat insulation layer, and a slip preventive layer located on the second waterproof covering.

DESCRIPTION OF THE PREFERRED EMBODIMENT

Figure 1:
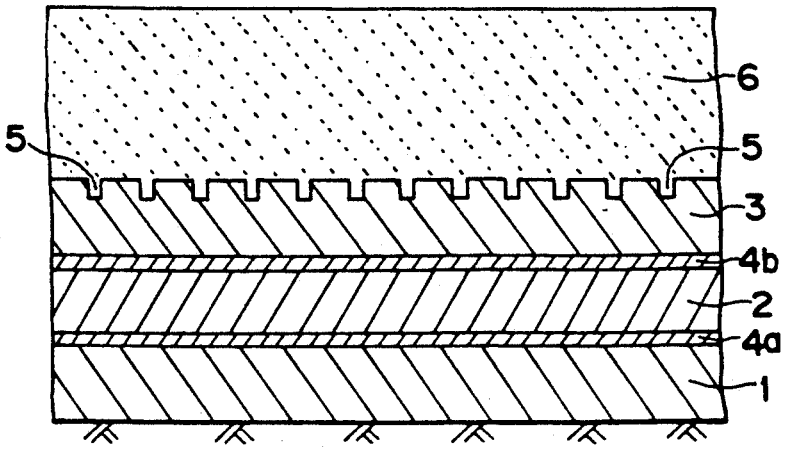
FIG. 1 is a sectional view of a first embodiment of floor structure for indoor artificial skiing ground according to the present invention.

FIG. 1 is a sectional view of a first embodiment of floor structure of the present invention. As shown in FIG. 1, the floor structure of this invention comprises a concrete base plate 1, a heat insulation layer 2 disposed over the base plate, and a concrete pressing plate 3 disposed over the heat insulation layer 2. On the upper surface of concrete pressing plate 3, a plurality of drainage ditches are formed. A first waterproof covering *4a* is located between the base plate 1 and the heat insulation layer 2, and a second waterproof covering *4b* between the second heat insulation layer 2 and the pressing plate 3. The heat insulation layer 2 is made of a heat insulation material such as blowing styrole and glass wool, whereas the first waterproof covering *4a* and the second waterproof covering *4b* are made of rubber asphalt sheet or similar materials. The artificial snow 6 laid on the floor constructed in the above manner will not melt from the surface of the snow heap if the indoor temperature in the artificial skiing ground is kept at 0° C. or less. Since the heat of ambient air enters from the floor bottom, the artificial snow is melted from its bottom by the heat of ambient air entering from the outside. Therefore, the thickness of insulation layer 2 is determined in accordance with the climate at the location where the artificial skiing ground is built. The thickness is so determined that the heaped snow melts by an amount corresponding to the supplied amount of artificial snow. Consequently, the heaped snow is renewed properly. The water produced by melting of snow flows toward the lower part of slope through the drainage ditches 5 formed on the upper surface of pressing plate 3, and then it is drained. Part of the water permeates into the pressing plate 3, but does not into the heat insulation layer 2 since the heat insulation layer 2 is covered with the waterproof covering 4b; the heat insulation layer 4b will not deteriorate.

Figure 2:
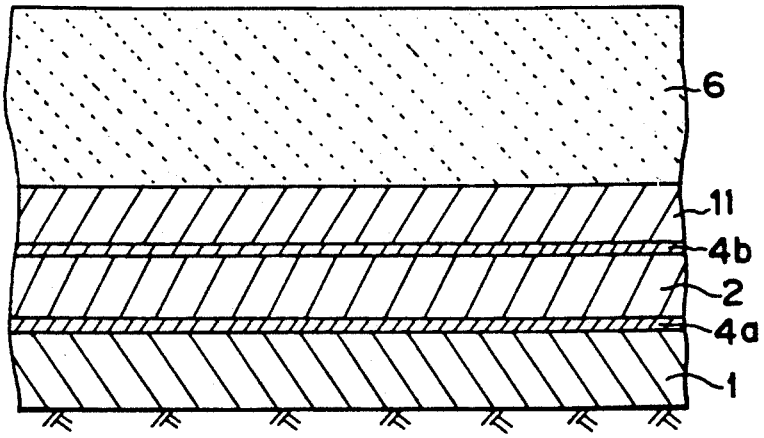
FIG. 2 is a sectional view of a second embodiment of the present invention.

FIG. 2 is a sectional view of a second embodiment of this invention. In this embodiment, the floor structure comprises a concrete base plate 1 constructed on foundations, a heat insulation layer 2 disposed over the base plate with a first waterproof covering 4a interposed between them, and artificial lawn 11 disposed over the heat insulation layer 2 with a second waterproof covering 4b interposed between them. The artificial lawn can drain the water produced by melting of snow, and also prevent the slip of artificial snow laid on its surface. The thickness of heat insulation layer 2 is determined in accordance with the climate as with the first embodiment. The thickness is so determined that the heaped snow melts by an amount corresponding to the supplied amount of artificial snow. Consequently, the heaped snow is renewed properly. The water produced by melting of snow flows toward the lower part of slope through the artificial lawn 11, and then it is drained. Part of the water permeates into the artificial lawn 11, but does not into the heat insulation layer 2 since the heat insulation layer 2 is covered with the waterproof covering 4b; the heat insulation layer 4b will not deteriorate.

Figure 3:
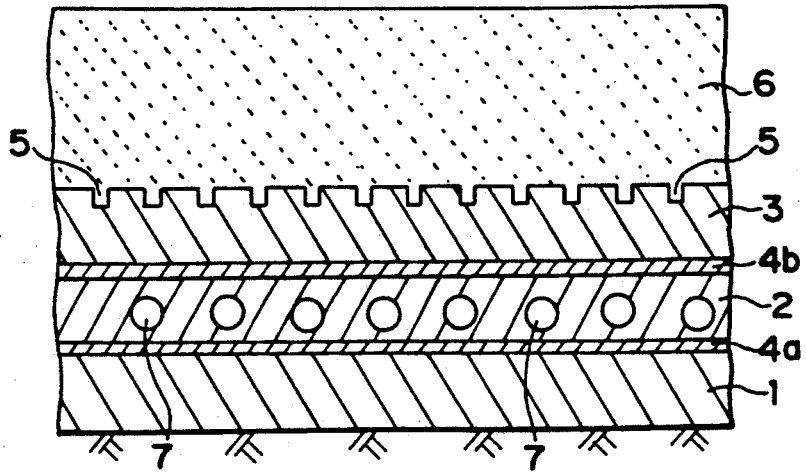
FIG. 3 is a sectional view of a third embodiment of the present invention.
Figure 4:
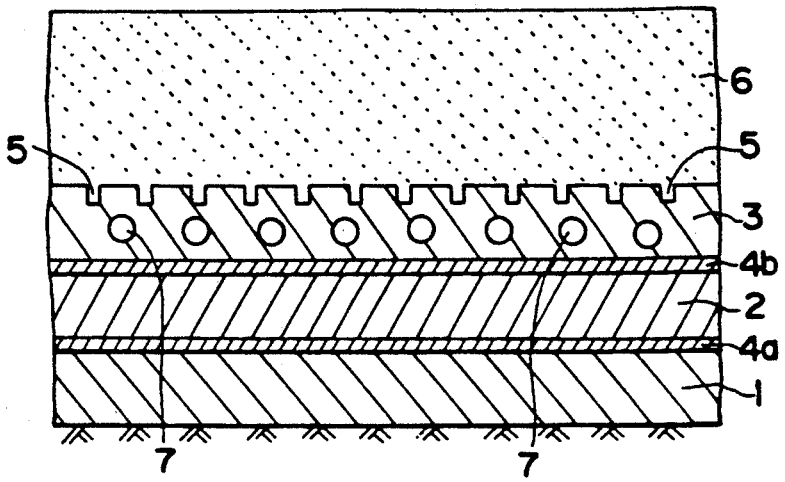
FIG. 4 is a sectional view of a fourth embodiment of the present invention.
Figure 5:
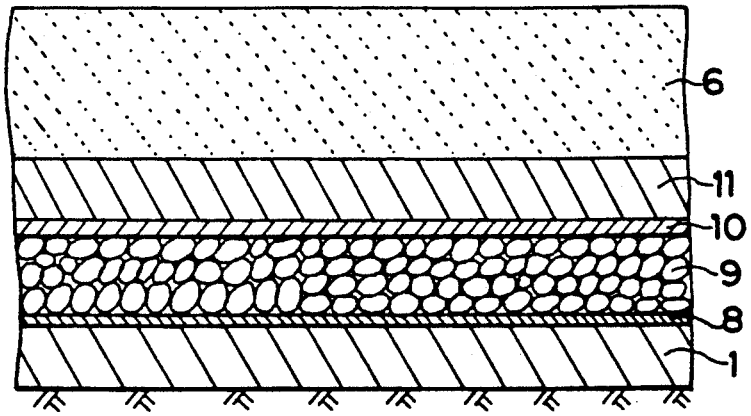
FIG. 5 PRIOR ART
FIGS. 5 and 6 are sectional views of the conventional floor structures for indoor artificial skiing ground.
Figure 6:
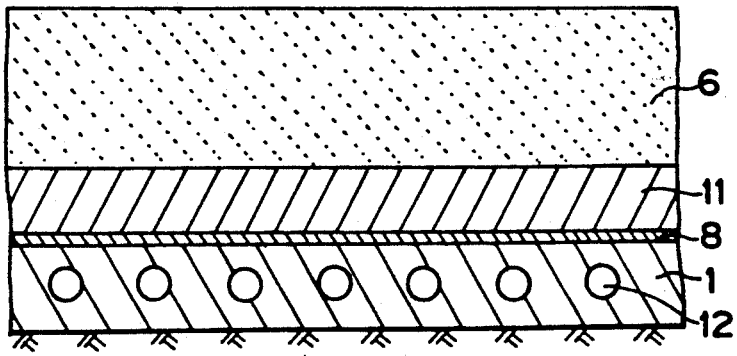
FIG. 6 PRIOR ART

FIG. 3 is a sectional view of a third embodiment of this invention. The floor structure of this embodiment, like the floor structure of the first embodiment, comprises a concrete base plate 1 constructed on foundations, a heat insulation layer 2 disposed over the base plate 1 with a waterproof covering 4a interposed between them, and a concrete pressing plate 3 disposed over the heat insulation layer 2 with a waterproof covering 4b interposed between them,. Also like the floor structure of the first embodiment, a plurality of drainage ditch 5 are formed on the upper surface of concrete pressing plate. In the floor structure of this third embodiment, pipes 7 are embedded in the heat insulation layer 2. A cooling or heating medium flows in the pipes 7. The flow of cooling or heating medium in the pipes 7 embedded in the heat insulation layer 2 controls the melted amount of artificial snow laid on the floor. FIG. 4 is a sectional view of a fourth embodiment of this invention. As shown in FIG. 4, the floor structure of this embodiment comprises a concrete base plate 1 constructed on foundations, a heat insulation layer 2 disposed over the base plate with a waterproof covering 4a interposed between them, a concrete pressing plate 3 disposed over the heat insulation layer 2 with a waterproof covering 4b interposed between them, and pipes 7 embedded in the pressing plate 3. The pressing plate 3 is made of impermeable concrete into which a waterproofing material is mixed. On the upper surface of pressing plate 3 are formed a plurality of drainage ditches 5. A cooling or heating medium flows in the pipes 7 to control the melted amount of artificial snow heaped on the floor. Since the concrete composing the pressing plate 3 is impermeable, the freezing of water entering the pressing plate 3 will not damage the pressing plate 3 and the pipes 7.

As described above, on the indoor artificial skiing ground having a floor structure of this invention, artificial snow is supplied and heaped on the floor and melts by an amount corresponding to the supplied amount. Therefore, a certain amount of powder-shaped artificial snow is laid at all times on the floor. The snow will neither become dirty nor be changed into Eisbahn, so that skiers can enjoy pleasant skiing in all seasons.

What is claimed is:

1. A floor structure for indoor artificial skiing ground, comprising;

a concrete base plate constructed on foundations;

a first waterproof covering disposed on said base plate;

a heat insulation layer located on said first waterproof covering;

a second waterproof covering disposed on said heat insulation layer;

a concrete pressing plate located on said second waterproof covering; and a plurality of drainage ditches formed on top of said pressing plate.

2. A floor structure according to claim 1, wherein said first and second waterproof covering are made of rubber asphalt sheet.

3. A floor structure according to claim 1, wherein said heat insulation layer is made of blowing styrole.

4. A floor structure according to claim 1, wherein said heat insulation layer is made of glass wool.

5. A floor structure according to claim 1, wherein said heat insulation layer has pipes therein.

6. A floor structure according to claim 1, wherein said pressing plate has pipes therein.

7. A floor structure for indoor artificial skiing ground, comprising;

a concrete base plate constructed on foundations;

a first waterproof covering disposed on said base plate;

a heat insulation layer located on said first waterproof covering;

a second waterproof covering disposed on said heat insulation layer, and a slip preventive layer located on said second waterproof covering.

8. A floor structure according to claim 7, wherein said first and second waterproof covering are made of rubber asphalt sheet.

9. A floor structure according to claim 7, wherein said heat insulation layer is made of blowing styrole.

10. A floor structure according to claim 7, wherein said heat insulation layer is made of glass wool.

11. A floor structure according to claim 7, wherein said slip preventive layer is artificial lawn.

* * * * *